US006815401B2

(12) United States Patent
Nakamura

(10) Patent No.: US 6,815,401 B2
(45) Date of Patent: Nov. 9, 2004

(54) OIL COMPOSITION FOR HEAT TREATMENT OF A GEAR AND GEAR TREATED BY USING THE OIL COMPOSITION

(75) Inventor: Eiichi Nakamura, Chiba-ken (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 09/983,193

(22) Filed: Oct. 23, 2001

(65) Prior Publication Data

US 2003/0096714 A1 May 22, 2003

(51) Int. Cl.[7] ..... C10M 137/04; B23K 35/22; C23C 22/03

(52) U.S. Cl. ..... 508/192; 508/287; 508/390; 508/421; 508/502; 508/586; 148/29; 148/246

(58) Field of Search ..... 148/292, 246, 148/29; 508/421, 192

(56) References Cited

U.S. PATENT DOCUMENTS 3,729,417 A * 4/1973 Hashimoto et al. ..... 148/29
3,925,113 A * 12/1975 Wilpers ..... 148/29
4,158,633 A * 6/1979 Papay ..... 252/32.7 E
4,356,097 A * 10/1982 Papay ..... 252/33.4
4,465,523 A * 8/1984 Katabuchi ..... 148/246
4,826,545 A * 5/1989 Foreman et al. ..... 148/29
4,832,867 A * 5/1989 Seiki et al. ..... 252/32.5
5,250,122 A * 10/1993 Uchida et al. ..... 148/29
5,328,619 A * 7/1994 Conary ..... 252/32.5
5,376,186 A * 12/1994 Uchida et al. ..... 148/29
5,569,644 A * 10/1996 Geibach et al. ..... 508/438
5,665,685 A * 9/1997 Takigawa ..... 508/421
5,763,372 A * 6/1998 Tersigni et al. ..... 508/436
5,942,470 A * 8/1999 Norman et al. ..... 508/189
6,096,691 A * 8/2000 Conary et al. ..... 508/189
6,239,082 B1 * 5/2001 Hewson et al. ..... 148/246

FOREIGN PATENT DOCUMENTS

| | | |
|---|---|---|
| JP | 47-20806 | 6/1972 |
| JP | 49-32288 | 8/1974 |
| JP | 2000-45017 | 2/2000 |
| JP | 2000-45018 | 7/2000 |
| JP | 2001-192689 | 7/2001 |

* cited by examiner

*Primary Examiner*—Ellen M McAvoy

(57) ABSTRACT

An oil composition for heat treatment of a gear which comprises mineral oil having a kinematic viscosity of 5 to 40 $mm^2$/second at 100° C. as a base oil and, based on a total amount of the composition, 0.01 to 5% by weight of (a) a phosphoric acid ester compound and, where necessary, 0.5 to 10% by weight of (b) one compound selected from alkenylsuccinimide compounds, alkylsuccinimide compounds and addition products of boron with alkenylsuccinimide compounds or alkylsuccinimide compounds and 0.5 to 10% by weight of (c) at least one compound selected from salicylates, phenates and sulfonates of alkaline earth metals.

A coating film is formed on the surface of a gear simultaneously with hardening of the gear and the gear can be provided with resistance to pitching.

6 Claims, No Drawings

OIL COMPOSITION FOR HEAT TREATMENT OF A GEAR AND GEAR TREATED BY USING THE OIL COMPOSITION

BACKGROUND OF THE INVENTION

1. Field of the Invention

The present invention provides an oil composition for heat treatment of a gear and a gear treated by using the oil composition and, more particularly, an oil composition for heat treatment of a gear which is used in the quenching step of the gear so that a coating film is formed on the surface of the gear simultaneously with hardening of the gear and the gear can be provided with resistance to pitching, and a gear quenched by using the oil composition.

2. Description of the Related Arts

Gears for automobiles are, in general, produced from raw materials such as SCR415, SCR420 (AISI5120), SCR430 (AISI5130), SCM415, SCM420 and SCM430 (AISI4130) by cutting or deformation processing of the raw materials, followed by carburisation, quenching and tempering. For cooling in the quenching step, in general, so-called quenching oil such as marquenching oil and modified marquenching oil is used.

Gears for automobiles are under increasingly greater loads due to decreases in the size and the thickness accompanied with a decrease in the weight of automobiles and also due to an increase in the output power accompanied with improvements in the performance of automobiles. To satisfy these requirements, materials for gears and the method for quenching have been improved. As the result of the improvements, damages on gears take place more frequently on the surface of teeth than at the dedendum. For example, damages such as pitching, scoring and wear are more frequent than damages such as fracture of the dedendum of the gears which has heretofore been the major damage. In particular, the damage of the surface of teeth due to pitching is the major damage under the condition of the ordinary use.

To decrease the damage due to pitching, teeth are polished after quenching or compression stress is applied to the surface by shot peening.

However, these methods have a drawback in practical application in that the operation of the treatment is complicated and requires a great amount of time and cost of the treatment increases. Therefore, these methods are applied only to gears subjected to extraordinarily great loads and gears used for high grade automobiles.

Therefore, development of a method for improving resistance to pitching of a gear which can be practiced in a simple operation easily at a low cost and practically applied widely has been strongly desired.

SUMMARY OF THE INVENTION

The present invention has an object of providing an oil composition for heat treatment of a gear which can improve resistance to pitching of the gear effectively in a simple operation.

Extensive studies have been made by the present inventors to achieve the above object. In the quenching step of a gear for automobiles, it has heretofore been considered to be most important that heat treated gear having stable quality is obtained. Therefore, no active compounds reacting with steel are added to the quenching oil so that the properties do not change even when the quenching oil always has steel of about 850° C. placed therein. Despite the above conventional practice, the present inventors paid attention to using in the quenching oil an additive which react with the surface of steel and can improve resistance to pitching of the gear. Thus, it was found that the resistance to pitching was improved by adding a phosphoric acid ester compound to a quenching oil. It was also found that, although stability to oxidation is adversely affected by the use of the above compound, the change in the property could be suppressed by suitably adding an alkenylsuccimide compound, an alkylsuccinimide compound or a salicylate, phenate or sulfonate of an alkaline earth metal and a heat treated gear exhibiting excellent resistance to pitching and stable quality could be obtained. The present invention has been completed based on the knowledge.

The present invention provides:

(1) An oil composition for heat treatment of a gear which comprises mineral oil having a kinematic viscosity of 5 to 40 $mm^2$/second at 100° C. as a base oil and, based on a total amount of the composition, 0.01 to 5% by weight of (a) a phosphoric acid ester compound (Composition I);

(2) An oil composition for heat treatment of a gear which comprises mineral oil having a kinematic viscosity of 5 to 40 $mm^2$/second at 100° C. as a base oil and, based on a total amount of the composition, 0.01 to 5% by weight of (a) a phosphoric acid ester compound and 0.5 to 10% by weight of (b) one compound selected from alkenylsuccinimide compounds, alkylsuccinimide compounds and addition products of boron with alkenylsuccinimide compounds or alkylsuccinimide compounds (Composition II);

(3) An oil composition for heat treatment of a gear which comprises mineral oil having a kinematic viscosity of 5 to 40 $mm^2$/second at 100° C. as a base oil and, based on a total amount of the composition, 0.01 to 5% by weight of (a) a phosphoric acid ester compound and 0.5 to 10% by weight of (c) at least one compound selected from salicylates, phenates and sulfonates of alkaline earth metals (Composition III);

(4) An oil composition for heat treatment of a gear which comprises mineral oil having a kinematic viscosity of 5 to 40 $mm^2$/second at 100° C. as a base oil and, based on a total amount of the composition, 0.01 to 5% by weight of (a) a phosphoric acid ester compound, 0.5 to 10% by weight of (b) one compound selected from alkenylsuccinimide compounds, alkylsuccinimide compounds and addition products of boron with alkenylsuccinimide compounds or alkylsuccinimide compounds and 0.5 to 10% by weight of (c) at least one compound selected from salicylates, phenates and sulfonates of alkaline earth metals (Composition IV); and (5) A gear quenched by using any of Compositions I to IV.

DESCRIPTION OF THE PREFERRED EMBODIMENTS

In Compositions I to IV of the present invention, mineral oil having a kinematic viscosity of 5 to 40 $mm^2$/second, preferably 8 to 33 $mm^2$/second and more preferably 10 to 22 $mm^2$/second at 100° C. is used as the base oil. When the kinematic viscosity of the base oil is smaller than the above range, uneven cooling takes place and strain by the quenching increases since the starting temperature of the convection stage becomes lower and the vapor film stage becomes longer. Moreover, the working environment deteriorates and danger of fire increases due to generation of mist. When the kinematic viscosity is greater than the above range, the starting temperature of the convection stage becomes higher and sufficient quenching cannot be achieved due to insufficient ability of cooling. Therefore, kinematic viscosities outside the above range are not preferable.

Other properties of the base oil used in the present invention are not particularly limited as long as the base oil has a kinematic viscosity in the above range. As the other properties, it is preferable that % $C_A$ as obtained in accordance with the ring analysis (the n-d-m method) is 2 to 15, the bromine number is 5 to 50 g/100 g, the content of sulfur is 50 ppm to 2% by weight and the pour point is −10° C. or lower. When % $C_A$ is smaller than 2, the change in the cooling property due to heat decomposition tends to increase. When % $C_A$ exceeds 15, the life of brightness occasionally decreases due to deterioration by oxidation. When the bromine number is smaller than 5 g/100 g, the change in the cooling property due to heat decomposition occasionally increases. When the bromine number exceeds 50 g/100 g, the life of brightness tends to decrease due to deterioration by oxidation. When the content of sulfur is smaller than 50 ppm by weight, the change in the cooling property due to heat decomposition tends to increase. When the content of sulfur exceeds 2% by weight, the life of brightness decreases in many cases due to deterioration by oxidation. When the pour point exceeds −10° C., the fluidity at low temperatures is occasionally insufficient.

As described above, various types of mineral oil are available and a suitable mineral oil can be selected in accordance with the situation. Examples of the mineral oil include distilled oils obtained by atmospheric distillation of paraffinic crude oils, intermediate crude oils and naphthenic crude oils, distilled oils obtained by vacuum distillation of residual oils of the atmospheric distillation and purified oils obtained by purifying the above oils in accordance with a conventional process such as oils purified with solvents, oils purified by hydrogenation, oils treated by dewaxing and oils treated with white clay.

The base oil may be used singly or in combination of two or more.

Compositions I to IV of the present invention comprise (a) a phosphoric acid ester compound added to the above mineral oil. Various compounds may be used as the phosphoric acid ester compound. Examples of the phosphoric acid compound include phosphoric acid esters, acidic phosphoric acid esters, phosphorous acid esters and acidic phosphorous acid esters, which are represented by the following general formulae (i) to (v):

(i)

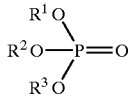

(ii)

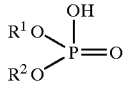

(iii)

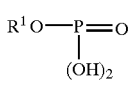

-continued (iv)

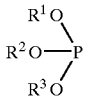

(v)

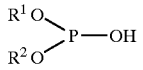

In the above general formulae (i) to (v), $R^1$ to $R^3$ each represents an alkyl group, an alkenyl group, an alkylaryl group or an arylalkyl group having 4 to 30 carbon atoms and may represent the same group or different groups.

Examples of the phosphoric acid ester compound include triaryl phosphates, trialkyl phosphates, trialkylaryl phosphates, triarylalkyl phosphates and trialkenyl phosphates. Specific examples of the phosphoric acid ester compound include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, di(ethylphenyl) phenyl phosphate, propylphenyl diphenyl phosphate, di(propylphenyl) phenyl phosphate, tri(ethylphenyl) phosphate, tri(propylphenyl) phosphate, butylphenyl diphenyl phosphate, di(butylphenyl) phenyl phosphate, tri(butylphenyl) phosphate, trihexyl phosphate, tri(2-ethylhexyl) phosphate, tridecyl phosphate, trilauryl phosphate, trimyristyl phosphate, tripalmityl phosphate, tristearyl phosphate and trioleyl phosphate.

Examples of the acidic phosphoric acid ester include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate and isostearyl acid phosphate.

Examples of the phosphorous acid ester include triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenyl isodecyl phosphite, tristearyl phosphite and trioleyl phosphite.

Examples of the acidic phosphorous acid ester include dibutyl hydrogenphosphite, dilauryl hydrogenphosphite, dioleyl hydrogen-phosphite, distearyl hydrogenphosphite and diphenyl hydrogenphosphite.

Among the above phosphoric acid ester compounds, acidic phosphoric acid esters such as 2-ethylhexyl acid phosphate, oleyl acid phosphate, lauryl acid phosphate and stearyl acid phosphate; and acidic phosphorous acid esters such as dilauryl hydrogenphosphite, dioleyl hydrogenphosphite and distearyl hydrogenphosphite are preferable.

In the present invention, the above component (a) may be used singly or in combination of two or more. Component (a) is used in an amount in the range of 0.01 to 5% by weight and preferably in the range of 0.1 to 1% by weight based on the total amount of the composition. When the amount is less than 0.01% by weight, the effect of preventing corrosion is insufficient and the synergistic effect with other components is occasionally not exhibited. When the amount exceeds 5% by weight, the stability of the quenching oil to oxidation is adversely affected and the life of brightness deteriorates. Therefore, amounts outside the above range are not preferable.

Compositions II and IV of the present invention comprises (b) one compound selected from alkenylsuccinimide compounds, alkylsuccinimide compounds and addition products of boron with alkenylsuccinimide compounds or alkylsuccinimide compounds. Examples of the alkenylsuccinimide compound and the alkylsuccinimide compound include mono compounds represented by the following general formula (vi):

(vi)

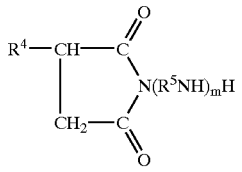

and bis compounds represented by the following general formula (vii):

(vii)

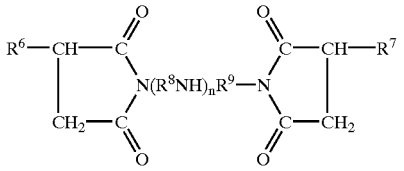

In the above formulae, $R^4$, $R^6$ and $R^7$ each represents an alkenyl group or an alkyl group having a number-average molecular weight of 300 to 4,000 and may represent the same group or different groups; $R^5$, $R^8$ and $R^9$ each represents an alkylene group having 2 to 4 carbon atoms and may represent the same group or different groups; m represents an integer of 1 to 10; and n represents 0 or an integer of 1 to 10.

In the above general formulae (vi) and (vii), it is preferable that $R^4$, $R^6$ and $R^7$ each represents an alkenyl group or an alkyl group having a number-average molecular weight of 900 to 3,000. Examples of the alkenyl group include polybutenyl group and ethylene-propylene copolymer groups. Examples of the alkyl group include groups obtained by hydrogenation of the above groups.

In the present invention, any of the mono compounds, the bis compounds and mixtures of the mono compounds and the bis compounds can be used.

The alkenylsuccinimide compound and the alkylsuccinimide compounds can be prepared, in general, by reacting an alkenylsuccinic anhydride obtained by the reaction of a polyolefin and maleic anhydride or an alkylsuccinic anhydride obtained by hydrogenation of the above alkenylsuccinic anhydride with a polyamine. The mono compounds and the bis compounds described above can be prepared selectively by changing relative amounts of the alkenylsuccinic anhydride or the alkylsuccinic anhydride and the polyamine used in the reaction. As the olefin monomer for forming the above polyolefin, an α-olefin having 2 to 8 carbon atoms or a mixture of two or more α-olefins having 2 to 8 carbon atoms can be used. Mixtures of isobutene and butene-1 are preferable. Examples of the polyamine include simple diamines such as ethylenediamine, propylenediamine, butylenediamine and pentylenediamine; and polyalkylenepolyamines such as diethylenetriamine, triethylenetetramine, tetraethylenepentamine, pentaethylenehexamine, di(methylethylene)-triamine, dibutylenetriamine, tributylenetetramine and pentapentylene-hexamine.

As the addition product of boron with an alkenylsuccinimide compound or an alkylsuccinimide compound, compounds prepared in accordance with a conventional process can be used. For example, the above compound can be prepared by reacting the above polyolefin with maleic anhydride to obtain an alkenylsuccinic anhydride, followed by forming an imide by the reaction of the obtained alkenylsuccinic anhydride with an intermediate which is obtained by reacting the above polyamine with a boron compound such as boron oxide, a boron halide, boric acid, an ester of boric acid and an ammonium salt of boric acid. It is preferable that the content of boron in the addition product of boron is in the range of 0.1 to 6% by weight and more preferably in the range of 0.1 to 4% by weight.

In the present invention, the addition products of boron are preferable from the standpoint of the effect of improving the brightness.

In the present invention, the above component (b) may be used singly or in combination of two or more. Compound (b) is used in an amount in the range of 0.5 to 10% by weight and preferably in the range of 1 to 4% by weight based on the total amount of the composition. When the amount is less than 0.5% by weight, the effect of improving the brightness is insufficient and the synergistic effect with other components is occasionally not exhibited. When the amount exceeds 10% by weight, the stability under heating deteriorates. Therefore, amounts outside the above range are not preferable.

Compositions (III) and (IV) of the present invention comprises (c) at least one compound selected from salicylates, phenates and sulfonates of alkaline earth metals. The compound (c) has been heretofore used as the detergent-dispersant containing a metal. It is preferable that the total base number is in the range of 50 to 300 mg KOH/g (in accordance with the perchloric acid method of Japanese Industrial Standard K-2501). When the total base number is smaller than the above range, a sufficient effect cannot be obtained unless the compound is used in a great amount and economic disadvantage occasionally arises. When the total base number is greater than the above range, the solubility is occasionally insufficient. It is more preferable that the total base number is in the range of 150 to 250 mg KOH/g.

The salicylates of alkaline earth metals are alkaline earth metal salts of alkylsalicylic acids. In general, the salicylate of an alkaline earth metal is obtained by alkylation of phenol by introduction of an α-olefin having 8 to 18 carbon atoms, followed by introduction of carboxyl group into the product of the alkylation in accordance with the Kolbe-Schmitt reaction and, then, double decomposition and carbonation of the obtained product. Examples of the alkylsalicylic acid include dodecylsalicylic acid, dodecylmethylsalicylic acid, tetradecylsalicylic acid, hexadecylsalicylic acid, octadecylsalicylic acid and dioctylsalicylic acid.

The phenates of alkaline earth metals are alkaline earth metal salts of alkylphenols or alkylphenol sulfides. In general, the phenate of an alkaline earth metal is obtained by carbonation of an alkaline earth metal salt of an alkylphenol or an alkylphenol sulfide.

The sulfonates of alkaline earth metals are alkaline earth metal salts of various types of sulfonic acids. In general, the sulfonate of an alkaline earth metal is obtained by carbonation of an alkaline earth metal salt of a sulfonic acid. Examples of the sulfonic acid include aromatic petroleum sulfonic acids, alkylsulfonic acids, arylsulfonic acids and alkylarylsulfonic acids. Specific examples include dodecylbenzenesulfonic acid, dilaurylcetylbenzenesulfonic acid, benzenesulfonic acids substituted with paraffin wax, benzenesulfonic acids substituted with polyolefins, benzenesulfonic acids substituted with polyisobutylene and naphthalene-sulfonic acid.

Examples of the alkaline earth metal used in the above salicylates, phenates and sulfonates of alkaline earth metal salts include calcium, barium and magnesium. From the standpoint of the effect, calcium is preferable.

In the present invention, the above compound (c) may be used singly or in combination of two or more. Compound (c) is used in an amount in the range of 0.5 to 10% by weight and preferably in the range of 1 to 3% by weight based on the total amount of the composition. When the amount is less than 0.5% by weight, the effect of suppressing heat decomposition is insufficient and the synergistic effect with other components is occasionally not exhibited. When the amount exceeds 10% by weight, the effect expected from the used amount is not obtained and economic disadvantage arises.

Compositions I to IV of the present invention may comprise, where necessary, other additives such as antioxidants, defoaming agents and agents for improving cooling as long as the object of the present invention is not adversely affected.

Compositions I to IV of the present invention is advantageously used for the heat treatment of a gear, preferably for the heat treatment of a gear for automobiles and more preferably as the quenching oil. The gear for automobiles is produced by forging, followed by processing in steps of cutting teeth, carburisation, quenching and tempering. It is preferable that Compounds I to IV of the present invention heated at about 50 to 250° C. are used as the quenching oil in the step of carburisation and quenching. As the tank for the quenching, a tank of the closed type and a tank of the open type are used. The compositions of the present invention are suitable for use in the tank of the closed type.

The gear of the present invention is obtained by quenching using the above Compositions I to IV as the quenching oil. In accordance with this quenching, a coating film is formed on the surface simultaneously with hardening of the gear and the resistance to pitching is improved.

To summarize the industrial advantages of the present invention, when a gear is quenched using the oil composition for the heat treatment of the present invention, simultaneously with hardening of the gear by the quenching, a coating film can be formed by the reaction on the surface of the gear utilizing the heat at the time of quenching without adverse effects on the appearance (the brightness). As the result, both the hardness and the resistance to pitching can be provided in accordance with ordinary procedures of quenching and the fatigue life can be remarkably improved from that obtained in accordance with a conventional quenching process.

EXAMPLES

The present invention will be described more specifically with reference to examples in the following. However, the present invention is not limited to the examples.

Examples 1 to 4 and Comparative Example

Oil compositions for heat treatment (quenching oils) of Examples and Comparative Example were prepared by mixing components with a base oil, each shown in Table 1, in amounts also shown in Table 1. Using the quenching oils (fresh oils) of Examples and Comparative Example prepared above, the test of brightness, the test of the cooling property and the FZG gear test were conducted using test pieces in accordance with the methods described below. The results are shown in Table 2.

Using the above quenching oils (the fresh oils), the Indiana oxidation test was conducted and the properties of the quenching oils obtained after the treatment at 170° C. for 48 hours (oxidized oils) were measured. The results and the properties of the fresh oils are shown in Table 3.

Test of Brightness

In an atmosphere of a mixture of nitrogen and hydrogen (3:1), test pieces of S45C (AISI1045) and SUJ-2 (AISI E52100) heated at 850° C. were thrown into a quenching oil kept at 120° C. The brightness was evaluated by visually observing the color of the surface of the test pieces.

Test of Cooling Property

The cooling property was evaluated in accordance with the method of Japanese Industrial Standard K-2242. A silver probe was inserted into an oil for the test kept at 120° C. and the cooling curve was recorded. The H value was obtained in accordance with the Tamura's method.

FZG Gear Test (Test of Fatigue Life)

A gear for the FZG gear test was heated at 850° C. for 30 minutes in an atmosphere containing no oxygen and quenched in a quenching oil kept at 100° C. The quenched gear was tempered at 180° C. for 60 minutes.

The tempered gear was conditioned for 2 hours at an oil temperature of 60° C. in six stages using an oil for automatic transmission of automobiles and then the fatigue life test was conducted at an oil temperature of 90° C. at a rotation speed of 1,450 rpm in nine stages. LC50 (hour) was used for evaluation of the fatigue life.

TABLE 1

| Components of quenching oil | (Composition, % by weight) Example 1 | 2 | 3 | 4 | Comparative Example |
|---|---|---|---|---|---|
| Mineral oil *1 | 99 | 97 | 98 | 96 | 100 |
| Phosphate *2 | 1 | 1 | 1 | 1 | — |
| Imide containing boron *3 | — | 2 | — | 2 | — |
| Salicylate *4 | — | — | 1 | 1 | — |

TABLE 2

| | Example 1 | 2 | 3 | 4 | Comparative Example |
|---|---|---|---|---|---|
| Cooling property H value (1/cm) | 0.105 | 0.106 | 0.106 | 0.106 | 0.105 |
| Brightness | excellent | excellent | excellent | excellent | excellent |
| Fatigue life LC50 (hour) | 404 | 388 | 360 | 345 | 84 |

TABLE 3

| | Example 1 | 2 | 3 | 4 | Comparative Example |
|---|---|---|---|---|---|
| Properties of fresh oil | | | | | |
| kinematic viscosity at 100° C. ($mm^2$/second) | 18.6 | 19.0 | 18.7 | 19.0 | 18.7 |
| total acid value (mg KOH/g) | 3.10 | 2.08 | 2.32 | 2.05 | 0.23 |

TABLE 3-continued

| | Example | | | | Comparative |
|---|---|---|---|---|---|
| | 1 | 2 | 3 | 4 | Example |
| Properties of oxidized oil | | | | | |
| kinematic viscosity at 100° C. ($mm^2$/second) | 23.5 | 21.4 | 22.1 | 21.2 | 20.5 |
| total acid value (mg KOH/g) | 5.76 | 3.60 | 4.18 | 3.45 | 1.50 |
| Difference in properties of fresh oil and oxidized oil | | | | | |
| ratio of kinematic viscosity at 100° C. *5 | 1.26 | 1.13 | 1.18 | 1.12 | 1.10 |
| difference in total acid number *6 (mg KOH/g) | 2.66 | 1.52 | 1.86 | 1.40 | 1.27 |

Notes to Tables 1 and 3

*1: A paraffinic mineral oil (% $C_A$:3.5; the bromine number:15 g/100 g; the content of sulfur:150 ppm by weight)

*2: 2-Ethylhexyl acid phosphate

*3: Polybutenylsuccinimide containing boron (the number-average molecular weight of butenyl group:1,000; the content of boron:2% by weight)

*4: Ca salicylate (the total base number:210 mg KOH/g)

*5: The kinematic viscosity of the oxidized oil / the kinematic viscosity of the fresh oil

*6: The total acid value of the oxidized oil - the total acid value of the fresh oil

What is claimed is:

1. A gear prepared by a process comprising a quenching step, the improvement comprising quenching said gear with an oil composition for heat treatment of a gear comprising: mineral oil having a kinematic viscosity of 5 to 40 $mm^2$/second at 100° C. as a base oil and, based on a total amount of the composition, 0.01 to 5% by weight of (a) a phosphoric acid ester compound.

2. A gear prepared by a process comprising a quenching step, the improvement comprising quenching said gear with an oil composition for heat treatment of a gear comprising: mineral oil having a kinematic viscosity of 5 to 40 $mm^2$/second at 100° C. as a base oil and, based on a total amount of the composition, 0.01 to 5% by weight of (a) a phosphoric acid ester compound, further comprising, based on a total amount of the composition, 0.5 to 10% by weight of (b) one compound selected from alkenylsuccinimide compounds, alkylsuccinimide compounds and addition products of boron with alkenylsuccinimide compounds or alkylsuccinimide compounds.

3. A gear prepared by a process comprising a quenching step, the improvement comprising quenching said gear with an oil composition for heat treatment of a gear comprising: mineral oil having a kinematic viscosity of 5 to 40 $mm^2$/second at 100° C. as a base oil and, based on a total amount of the composition, 0.5 to 10% by weight of (c) at least one compound selected from salicylates, phanates and sulfonates of alkaline earth metals.

4. A gear prepared by a process comprising a quenching step, the improvement comprising quenching said gear with an oil composition for heat treatment of a gear comprising: mineral oil having a kinematic viscosity of 5 to 40 $mm^2$/second at 100° C. as a base oil and, based on a total amount of the composition, 0.01 to 5% by weight of (a) a phosphoric acid ester compound, further comprising, based on a total amount of the composition, 0.5 to 10% by weight of (b) one compound selected from alkenylsuccinimide compounds, alkylsuccinimide compounds and addition products of boron with alkenylsuccinimide compounds or alkylsuccinimide compounds, further comprising, based on a total amount of the composition, 0.5 to 10% by weight of (c) at least one compound selected from salicylates, phanates and sulfonates of alkaline earth metals.

5. A gear prepared by a process comprising a quenching step, the improvement comprising quenching said gear with the oil composition for heat treatment of a gear comprising: mineral oil having a kinematic viscosity of 5 to 40 $mm^2$/second at 100° C. as a base oil and, based on a total amount of the composition, 0.01 to 5% by weight of (a) a phosphoric acid ester compound, wherein said mineral oil has a kinematic viscosity of 10 to 20 $mm^2$/second at 100° C.

6. A gear prepared by a process comprising a quenching step, the improvement comprising quenching said gear with the oil composition for heat treatment of a gear comprising: mineral oil having a kinematic viscosity of 5 to 40 $mm^2$/second at 100° C. as a base oil and, based on a total amount of the composition, 0.01 to 5% by weight of (a) a phosphoric acid ester compound, wherein said base oil has a % CA obtained in accordance with the ring analysis n-d-m method of 2 to 15, a bromine number of 5 to 50 g/100 g, a sulfur content of 50 ppm—2% by weight, and a pour point of 10° C. or lower.

* * * * *